US007027603B2

(12) United States Patent
Taenzer

(10) Patent No.: US 7,027,603 B2
(45) **Date of Patent: *Apr. 11, 2006**

(54) EAR LEVEL NOISE REJECTION VOICE PICKUP METHOD AND APPARATUS

(75) Inventor: Jon C. Taenzer, Los Altos, CA (US)

(73) Assignee: GN Resound North America Corporation, Redwood City, CA (US)

( * ) Notice: Subject to any disclaimer, the term of this patent is extended or adjusted under 35 U.S.C. 154(b) by 417 days.

This patent is subject to a terminal disclaimer.

(21) Appl. No.: 10/372,693

(22) Filed: Feb. 21, 2003

(65) Prior Publication Data

US 2003/0156722 A1 Aug. 21, 2003

Related U.S. Application Data

(62) Division of application No. 09/107,417, filed on Jun. 30, 1998, now Pat. No. 6,700,985.

(51) Int. Cl.
*H04R 3/00* (2006.01)
*H04R 9/08* (2006.01)

(52) U.S. Cl. ..... 381/92; 381/356

(58) Field of Classification Search ..... 381/92, 381/356–357, 71.6

See application file for complete search history.

(56) References Cited

U.S. PATENT DOCUMENTS

| | | | | |
|---|---|---|---|---|
| 3,770,911 | A | 11/1973 | Knowles et al. | |
| 3,777,079 | A | 12/1973 | Fischer | |
| 3,946,168 | A | 3/1976 | Preves | |
| 4,972,468 | A | 11/1990 | Murase | |
| 5,029,216 | A | 7/1991 | Jhabvala et al. | |
| 5,701,344 | A | 12/1997 | Wakui | |
| 5,740,262 | A | 4/1998 | Yoshida et al. | |
| 5,825,897 | A * | 10/1998 | Andrea et al. | 381/71.6 |
| 6,700,985 | B1 * | 3/2004 | Taenzer | 381/356 |

* cited by examiner

*Primary Examiner*—Laura A. Grier
(74) *Attorney, Agent, or Firm*—Michael J. Bolan; Bingham McCutchen LLP

(57) ABSTRACT

A highly discreet and accurate voice pickup device includes a standard miniature pressure gradient type microphone element provided and mounted very close to the side of the user's head, preferably near the user's ear. The microphone element is oriented so that its direction of maximum sensitivity is parallel to the side of the user's head, and points toward the user's mouth so that it will pick up the user's speech sounds as the sounds diffract and travel along the side of the user's face and head, to the microphone element. The microphone element can be configured with low pass networks at front and rear ports of the microphone element, which cooperate with air volumes within the microphone to provide additional directional properties that advantageously vary with frequency and further enhance the noise-rejection capability of the microphone element.

20 Claims, 10 Drawing Sheets

405 A (0, 500, 1.0, 100) +130
410 A (0, 1000, 1.0, 100) +130
420 A (0, 2000, 1.0, 100) +130
440 A (0, 4000, 1.0, 100) +130

EAR LEVEL NOISE REJECTION VOICE PICKUP METHOD AND APPARATUS

This application is a Divisional of Prior application Ser. No. 09/107,417 filed Jun. 30, 1998, (35 USC §120), now U.S. Pat. No. 6,700,985.

BACKGROUND OF THE INVENTION

1. Field of the Invention

The present invention relates generally to sound capture, and particularly to capturing a user's voice sounds.

2. State of the Art

Some users require devices such as voice pickups that provide a high quality capture of sound, for example, of the user's speech, and that are compact, discreet and convenient. For example, U.S. Secret Service agents assigned to covertly protect individuals require two way communications systems that are unobtrusive and allow them to clearly communicate with remote locations. Such an application requires a sound pickup that an agent can wear which is both discreet and accurate, particularly in situations such as a crowded room where ambient sound levels are high. Conventional two way communications systems used in such applications typically have boom-mounted or lapel-mounted microphones. Boom-mounted microphones are difficult to conceal, and lapel-mounted microphones and other conventional microphones mounted remotely from the user's mouth often suffer from a relatively low signal-to-noise ratio, especially in noisy environments.

One way that has been tried for improving the signal-to-ambient noise ratio has been to employ directional microphones. For example, miniature directional microphones have been used that are pressure gradient microphones which have been modified by the incorporation of delay networks that include an acoustic delay line into the rear port, as shown for example in FIG. 2 of the Knowles Electronics, Inc. Technical Bulletin TB21, which is hereby incorporated by reference. As described in Bulletin TB21, use of a one-port delay produces useful directional polar patterns, which can be tuned by selecting different ratios of front-to-back port spacing and selecting the rear port acoustic delay.

In these microphones, the necessary acoustic delay is formed by a combination of the compliance, created by the volume of air trapped in the microphone element, the acoustic inertance due to the mass of air in the port opening, and an acoustic resistance provided by an acoustic damper added to the port as described for example in "Subminiature Directional Microphones" in a paper by Elmer V. Carlson and Mead C. Killion, presented on Sep. 10, 1973 at the Convention of the Audio Engineering Society in New York, and which is hereby incorporated by reference. Such an acoustic network can be made to produce an acoustic delay which is very constant over frequency and which does not attenuate the delayed signal over the design frequency bandwidth. In addition, the front port is intentionally designed to minimize both its acoustic delay and attenuation characteristics. These properties are critically necessary for the microphone to have the desired directional characteristics, which do not vary with frequency. However, they still suffer from sound quality and signal-to-ambient noise ratio problems, and tend to be relatively large and noticeable.

Accordingly, there is a need for a voice pickup device and method that are both highly discreet, and capable of capturing a user's speech with a high sound quality and a relatively large signal-to-ambient noise ratio.

SUMMARY OF THE INVENTION

The present invention is directed to a voice pickup device and method that are highly discreet, and which capture a user's speech with a high sound quality and a relatively large signal-to-ambient noise ratio.

In an exemplary embodiment of the invention, a standard miniature pressure gradient type microphone element is provided and mounted very close to the side of the user's head, preferably near the user's ear. The microphone element is oriented so that its direction of maximum sensitivity is parallel to the side of the user's head, and pointing as much as possible toward the user's mouth. In this fashion, the microphone element picks up the user's speech sounds as the sounds diffract and travel along the side of the user's face and head, to the microphone element.

In another embodiment of the invention, a miniature pressure gradient type microphone element is provided with low pass networks formed using acoustic resistances at front and rear ports of the microphone, instead of delay networks. These resistances are matched by design with air volumes in the ports, so that the resistances and the air volumes together act as acoustic low-pass networks that provide directional sound pickup properties that vary with frequency. These directional properties further enhance the noise-rejection capability of the microphone element.

BRIEF DESCRIPTION OF THE DRAWINGS

Other objects and advantages of the present invention will become apparent to those skilled in the art from the following detailed description of preferred embodiments, when read in conjunction with the accompanying drawings. Like elements have been designated with like reference numerals.

DETAILED DESCRIPTION OF THE PREFERRED EMBODIMENTS

In accordance with a first preferred embodiment of the invention, a standard miniature pressure gradient microphone element is worn on the side of the user's head preferably near the user's ear.

Figure 12:
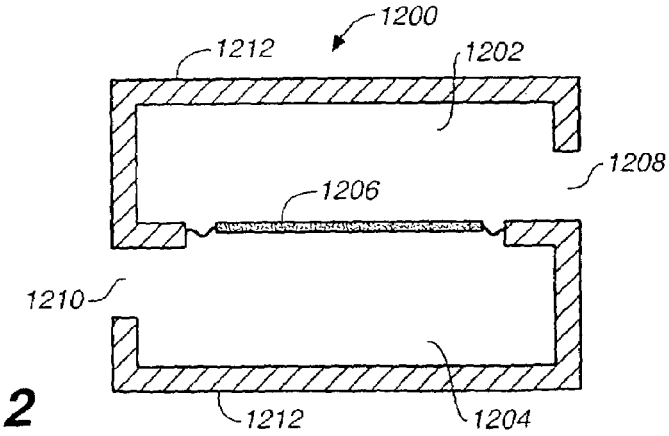
FIG. 12 is a cross sectional view of a pressure gradient microphone element.

As shown in FIG. 12, a pressure gradient microphone element 1200 is typically constructed using a membrane or diaphragm 1206 within a housing 1212, where the membrane effectively divides the housing to form two chambers 1202, 1204 in the housing 1212. The housing 1212 has an aperture, or port 1210, 1208, on each side of the membrane 1206, so that each chamber 1202, 1204 is connected via a port 1210, 1208 to the outside environment. When there is a pressure differential between the two ports 1210, 1208, as for example when a pressure wave passes through one port 1210 to enter one chamber 1204 but does not pass through the other port 1208 into the other chamber 1202, there will be a pressure difference between the two chambers 1204, 1202. This pressure difference will cause the membrane 1206 to move, thus generating an electrical signal that represents this pressure differential and thus the corresponding sound.

When a sound originates from a source distant to the microphone element 1200, it will travel essentially equal path distances to arrive at the ports 1208, 1210, so that when it arrives at the ports 1208, 1210 substantially equal sound pressures will be present on both sides of the membrane 1206 and little signal will be generated. In contrast, sounds that originate in close proximity to the pressure gradient microphone element 1200 develop a pressure differential across the membrane 1206, and consequently the microphone element 1200 will emit a corresponding output signal.

Thus, pressure gradient microphones are near-field devices, also known as "close-talking" microphones, that respond primarily to sounds originating in close proximity to the microphone element and with a velocity vector that is parallel to a line through the two ports of the microphone element. Telephones and other communications devices use such near-field microphones to suppress distant sounds and ambient noises, but the microphone element must be near to the speaker's mouth; hence the use of boom-mounted microphones on headsets. In accordance with embodiments of the invention and as described herein, such microphone elements can effectively capture a user's speech sounds with good noise rejection characteristics when located on the side of the user's head and properly oriented. As described below, a proper orientation allows embodiments of the invention to advantageously use the diffraction effect caused by the user's head.

Figure 2:
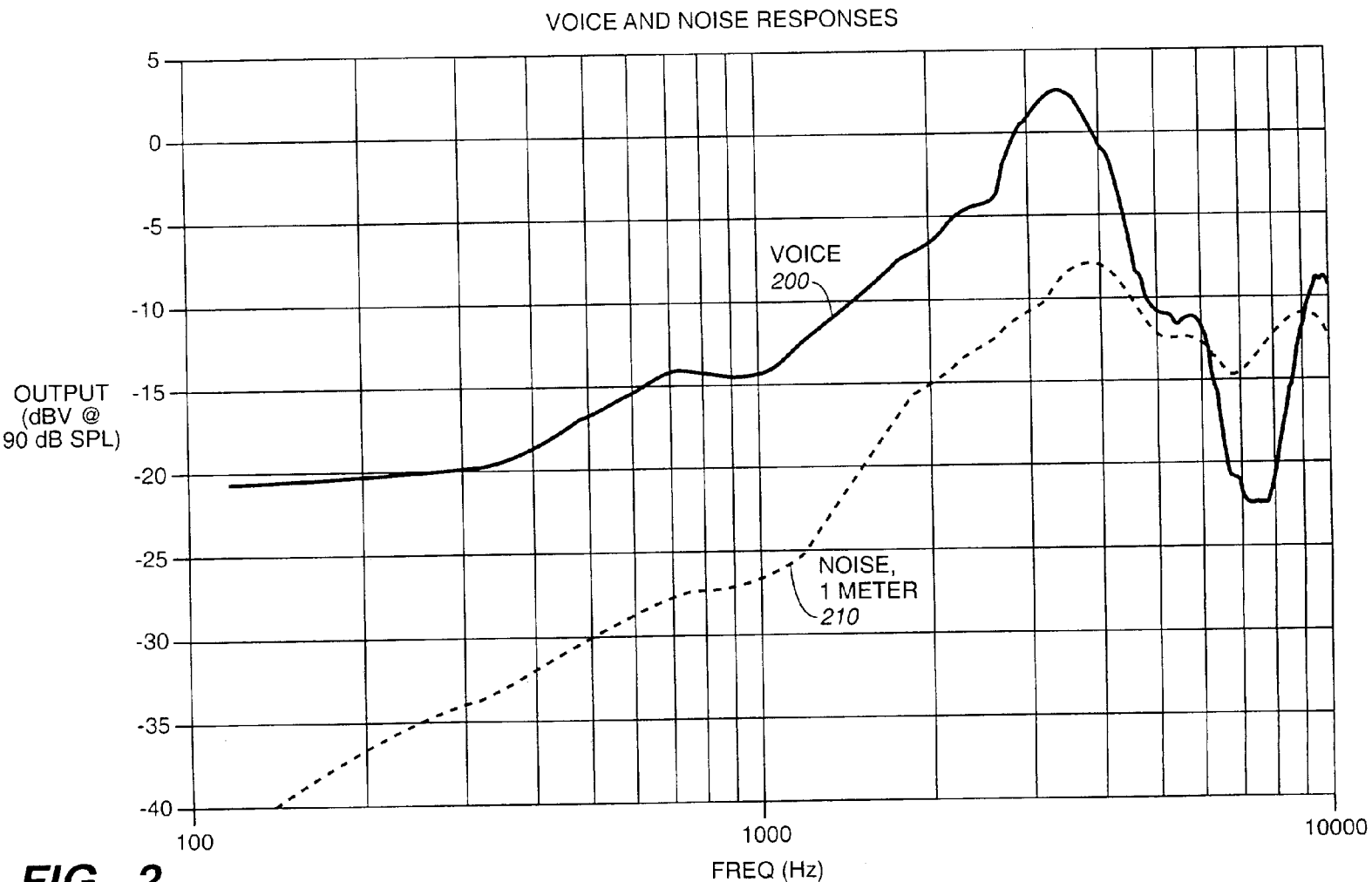
FIG. 2 is a graph showing the frequency response of an embodiment of the invention mounted on the user's head near the user's right ear, with respect to the user's speech sounds and with respect to a noise sound source one meter in front of the user.
Figure 8:
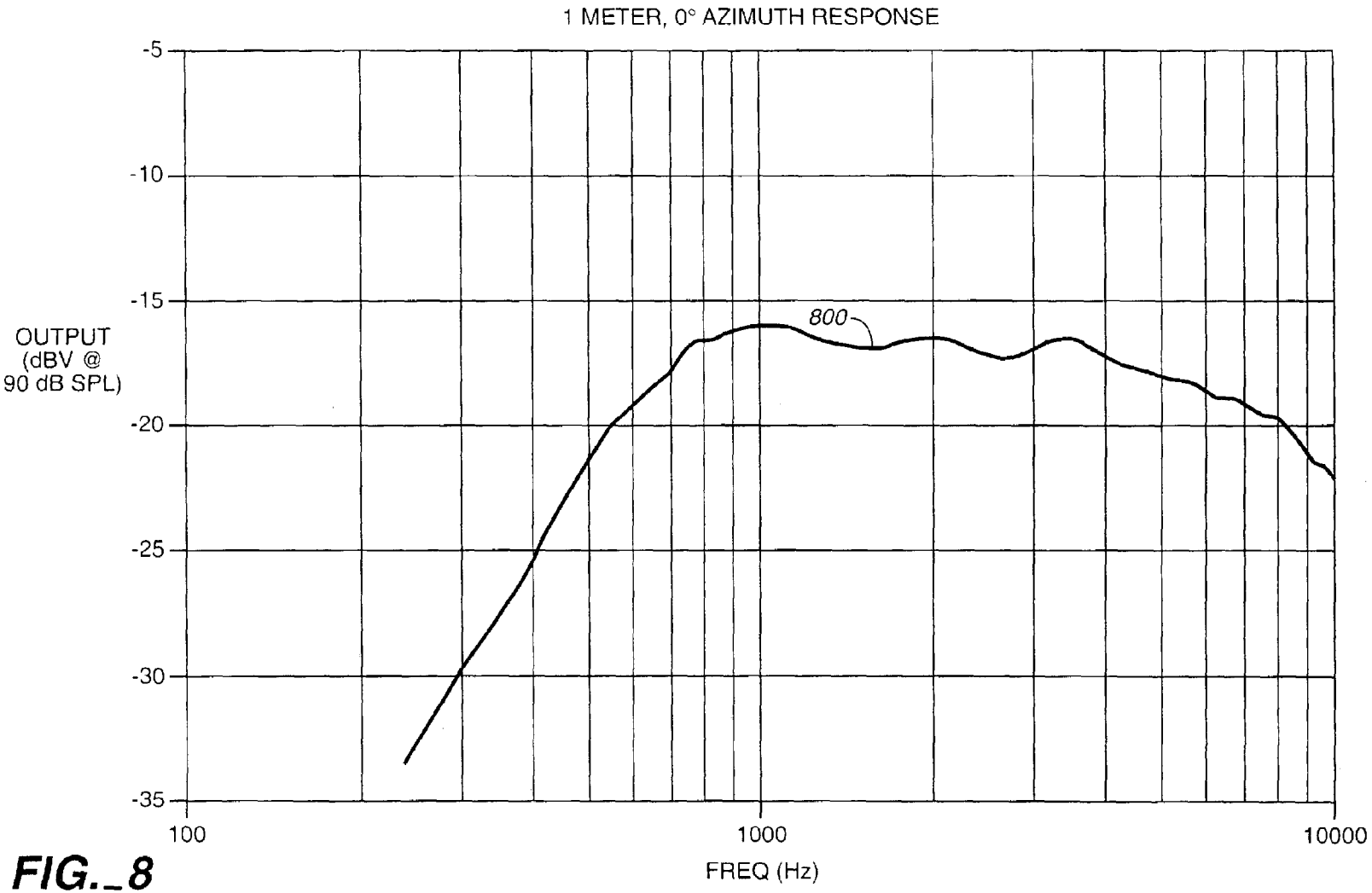
FIG. 8 is a graph of the actual frequency response of the embodiment of FIG. 4A when in a free field and contained within a microphone housing, with respect to a sound source one meter in front of the embodiment in a direction of maximum sensitivity which is the 0 degree direction.

The microphone element of the first preferred embodiment has a free field directional response that describes a figure 8 pattern when represented on a polar graph, as shown for example in FIG. 2 of "Directional Microphones", published by Harry Olson in the Journal of the Audio Society on October, 1967 (which is hereby incorporated by reference). The microphone element of the first preferred embodiment is preferably oriented so that the long axis of the figure 8 pattern parallels the surface of the side of the user's head and points towards the mouth of the user. The microphone element is most sensitive along this long axis, and has equal sensitivity in both directions along the long axis, to the front and the rear of the user.

Figure 1:
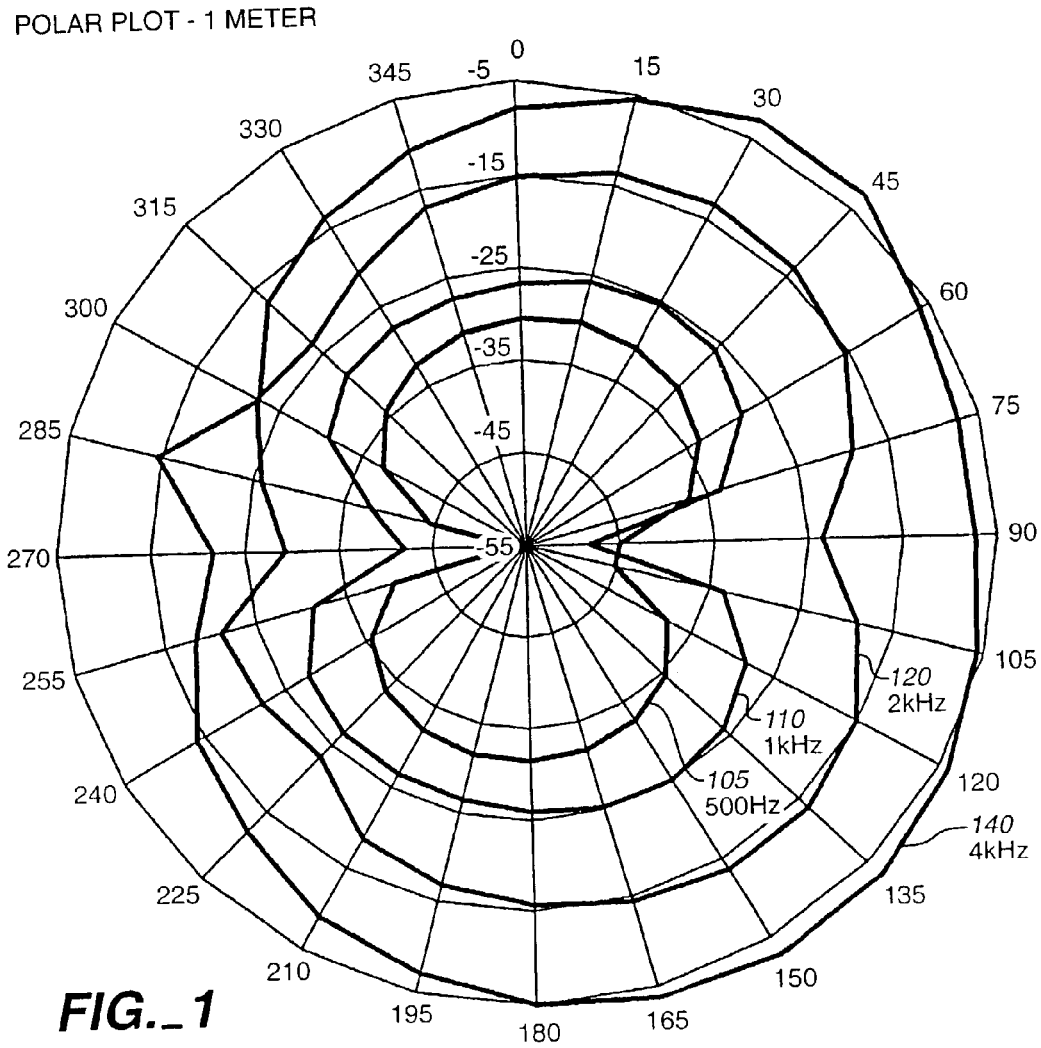
FIG. 1 is a polar graph of the frequency response of an embodiment of the invention worn in a user's right ear, looking down upon the user where 0 degrees indicates a forward direction, i.e., the direction in which the user is facing.

FIG. 1 shows a polar frequency response of the microphone element as mounted on the side of the user's head, with respect to a free field sound source located 1 meter away from the user and the microphone element. The viewpoint of the graph shown in FIG. 1 is a top view as if one were looking down on the user and the microphone element from above, where the microphone element is located at the center of the graph. The numbers at the outer circumference of the graph indicate locations on a 360 degree circle around the microphone element, and the concentric reference circles of the graph represent different signal output levels from the microphone element. In FIG. 1 the concentric reference circles are located 10 dB apart.

As the sound source is moved along the 360 degree circle around the microphone element, signal output levels from the microphone element are measured for each location of the sound source to generate the curves 105–140. In other words, the curves 105, 110, 120 and 140 represent the sensitivity of the microphone element in different directions at frequencies of 500 Hz, 1 kHz, 2 kHz and 4 kHz respectively. For example, the curve 140 indicates that the microphone element is less sensitive to 4 kHz sound coming from a source 1 meter to the right of the microphone element in the 90 degree direction, than it is to a 4 kHz sound coming from a source 1 meter from the microphone element in the 30 degree direction. The response curves 105–140 are not symmetrical in the 90 and 270 degree directions, because the user's head is located between the microphone element and sounds coming from the left (e.g., from the 270 degree direction). This effect is known as the "head shadowing" effect.

Figure 11:
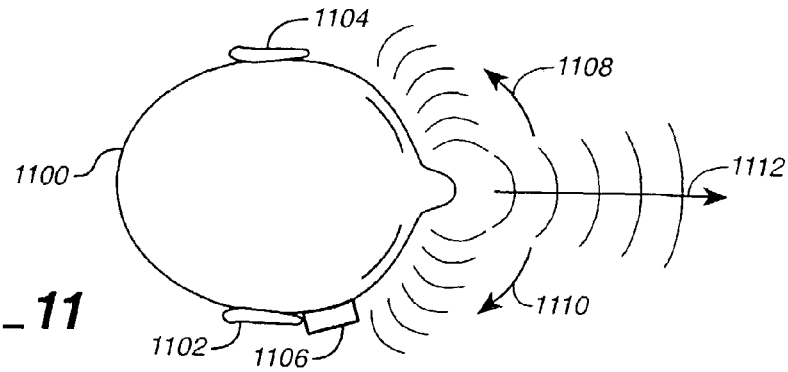
FIG. 11 is a top view of a user, showing the diffraction effect.

As shown in FIG. 11, a diffraction effect also occurs with respect to speech sounds from the user's mouth. FIG. 11 is a view of the user's head 1100 from above. When the user speaks, some of the sound energy travels into the free field in the direction 1112, and another portion of the sound energy diffracts and travels along the surface of the user's head 1100 in the directions 1108 and 1110. The microphone element of the first preferred embodiment is located on the side of the user's head 1100, near the user's ear 1102. Since diffracted sound energy from the user's voice travels from the user's mouth along the surface of the user's head 1100, the microphone element 1106 is in the path of this diffracted sound energy and captures the user's voice with good quality. In particular, the lower audio frequencies of the user's voice are better preserved in the diffracted sound energy that travels from the user's mouth along the user's head 1100, than in the portion of sound energy of the user's voice that travels from the user's mouth into the free field.

Since the lower frequencies of the user's voice are better preserved in the diffracted sound energy and therefore are more accurately captured by the microphone element, while ambient noise is unchanged, the signal-to-ambient noise ratio of the low frequency sound captured by the microphone element is greater than if the microphone were located, for example, at the user's lapel.

Furthermore, since the user's speech sounds come to the microphone element from substantially the 0 degree direction, and since all other sounds other than the user's speech are considered to be noise, the nulls in the 90 degree and 270 degree directions indicate that the microphone element of the first preferred embodiment exhibits very good noise rejection for environmental or ambient signals that arrive in directions substantially perpendicular to the long axis.

Preferably, the microphone element is tipped at about 45 degrees so that the long axis points along the surface of the user's head toward the user's mouth. Since the user's head essentially describes a convex surface and the user's mouth is on the front of the head while the microphone element is mounted on the side of the user's head, there is not a straight line between the microphone element and the user's mouth that does not pass through the user's head. In other words, the microphone element is "over the horizon" from the user's mouth, and is separated from the user's mouth by the surface convexity of the user's head. However, since diffracted sound from the user's mouth travels along the surface of the user's head, if the microphone element is oriented so that its direction of maximum sensitivity points along the diffracted sound's direction of travel, then this aspect of the signal-to-noise ratio of the user's speech with respect to ambient sounds can be maximized.

It is instructive to note that a rejection of 10-dB or more is very beneficial and can produce a major improvement in signal-to-noise ratio (SNR). With reference to FIG. 1, it can be seen that the nulls of the pattern seen on the right and left sides of the user's head in the 90 and 270 degree directions, as well as the additional head shadowing effect in the 270 degree direction, reduce noise pickup by as much as 20 dB.

A desired bandwith, over which sound is captured, can be specified to extend only from about 300 Hz to about 3 kHz. This bandwidth is commonly used in conventional telecommunications applications. Thus the loss of pattern nulls at higher frequencies, i.e., the deterioration of noise rejection with rise in frequency, is inconsequential above 3 kHz. This detioration can be seen by comparing, for example, the 4 kHz plot 140, the 2 kHz plot 120, the 1 kHz plot 110 and the 500 Hz plot 105.

As described in the "Subminiature Directional Microphones" reference, pressure gradient microphones have a frequency response that is decidedly "tilted" upward at high frequencies. Although sensitivity to high frequencies is similar in pressure gradient microphones and omnidirectional microphones, the sensitivity of pressure gradient microphones to low frequencies is comparatively reduced. This is why the concentric curves 105–140 of FIG. 1 are smaller for low frequencies, and larger for higher frequencies. Of course, the curves 105–140 represent the frequency response of a pressure gradient microphone for signals arriving from sound sources distant from the pressure gradient microphone, not the frequency response with respect to the user's own voice.

Curve 200 of FIG. 2 shows the frequency response of the first preferred embodiment of the invention with respect to the user's speech sounds, where the first preferred embodiment incorporates a pressure gradient microphone mounted on the user's head near the user's ear and is oriented with its axis of maximum sensitivity pointing toward the user's mouth. The curve 210 shows the frequency response of the first preferred embodiment with respect to a sound source one meter in front of the user. As can be seen from FIG. 2, the voice frequency response curve 200 shows much less tilt than the distant sound source frequency response curve 210. Thus, FIG. 2 shows the low frequency noise rejection of the first preferred embodiment, i.e., the difference between voice sensitivity and ambient noise sensitivity (SNR).

Since most environmental or ambient noises have their greatest energy at low frequencies, the effect of an improved SNR at low frequencies occurs right where it is most needed to give excellent noise rejection for an ear level pickup system. Additionally, because of its lesser slope, the voice signal can be more easily equalized to produce a desired flat frequency response.

Since the first preferred embodiment is sensitive along both directions of the long axis, for example from the 0 and 180 degree directions shown in FIG. 1, and since the user's voice only comes from the forward (0 degree) direction, noise rejection can be further enhanced by reducing sensitivity in the rearward (180 degree) direction in accordance with a second preferred embodiment of the invention.

In the second preferred embodiment, a miniature pressure gradient microphone having a membrane that separates two chambers, one forward chamber and one rearward chamber each connected via a port or aperture to the free field, is provided with an acoustic low pass network to reduce sensitivity in the rearward direction. A low pass network is provided for each port, and together the low pass networks and the ports produce an acoustic phase difference. This acoustic phase difference gives rise to additional direction characteristics.

In particular, the low pass networks, which include the air volumes of the forward and rearward chambers, cause the microphone element to demonstrate a polar directional response pattern that changes with the frequency of sound entering the microphone, unlike prior art directional microphones. The changes in pattern optimally reject environmental or ambient noises, by creating the best directionality at low frequencies where ambient or environmental noise is loudest. In addition, a front-to-back response ratio of better then 10 dB can be achieved even at higher frequencies where the polar pattern begins to degrade. One significant benefit of this is a much smaller microphone element with nearly the same SNR gain as a standard directional microphone element.

In further contrast to prior art directional microphones, which use acoustic delay networks instead of low pass networks, the inherent inertance due to the air mass in each port is not needed in the second preferred embodiment and is preferably minimized. The second preferred embodiment also does not require any extension tubing on either port in order to properly function, while some prior art directional microphones do require extension tubing in order to achieve proper acoustic delays that are necessary for directional properties. Thus, a voice pickup in accordance with the second preferred embodiment of the invention can be implemented as a very compact product.

Figure 3A:
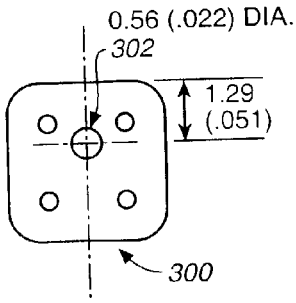
FIGS. 3A–C show a microphone element which can be incorporated in an embodiment of the invention.
Figure 3B:
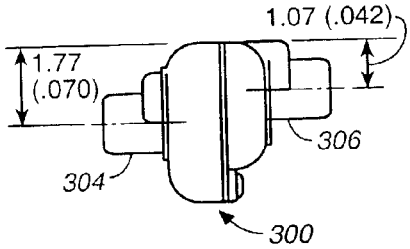
Figure 3C:
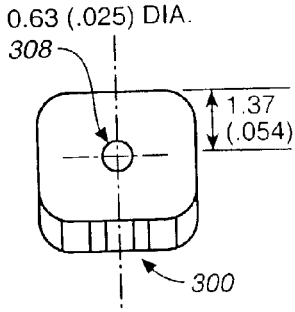

FIGS. 3A–C show details of a microphone in accordance with the second preferred embodiment, which can, for example, be constructed using a conventional microphone. For example, a Knowles Electronics, Inc. model EM-3068 omnidirectional, miniature electret hearing aid microphone 300 can be modified to create the microphone element of the second preferred embodiment. This microphone has a single, slit-shaped sound port located at the edge of the microphone assembly. Sound is supplied to the port via a metal tube used for convenient attachment of the acoustic "plumbing" that is commonly used with hearing aids. To reduce the magnitude of the inherent electroacoustic resonant peak at high frequencies of the EM-3068 microphone, Knowles provides an acoustic damper or resistor in the form of an acoustic screen in the metal tube.

To create the microphone element of the second preferred embodiment, this original metal sound tube is removed, and the slit-shaped sound port at the edge of the assembly is closed. As shown in FIGS. 3A and 3C, two new, additional round entry ports 302, 308 are made in the back and front sides of the microphone element to create a pressure gradient device. FIG. 3B is a side view of the microphone element 300, showing the relative placement of the two new sound ports 302, 308. The areas of the ports 302, 308 are purposely made large enough so that the port inertances are inconsequential to the overall system. Two sound tubes without acoustic dampers are then inserted into the entry ports 302, 308. These changes reconfigure the EM-3068 omnidirectional microphone into a classical pressure gradient device with polar patterns and frequency responses that are similar to those previously described and shown in FIGS. 1 and 2.

Acoustic dampers are then added to the two tubes so that equal acoustic resistances are present at each of the two ports 302, 308. This addition supplies further directional characteristics and converts the simple pressure gradient microphone element of the first preferred embodiment into the new microphone element of the second preferred embodiment. In other words, the only difference between the simple bi-directional gradient device and the directional device is the addition of acoustically significant resistances to each port, in order to produce the desired directional characteristics.

The EM-3068 has front and back volumes that, when used with equal acoustic resistances, produce the desired polar response patterns. However, adding equal acoustic resistances to different front and back volumes of other devices will not necessarily produce the desired polar response patterns, because directional response patterns depend on the interaction between the resistances and volumes. The appropriate front and back acoustic resistances necessary to produce the desired directional response patterns will thus vary depending on the volumes of the actual microphone used.

Adding acoustic resistance to each port produces acoustic low-pass filters at each port. As sound enters each port, the sound undergoes a phase shift. By creating different low-pass filters at each port, the sound undergoes different phase shifts at each port and a phase difference develops across the microphone membrane or diaphragm. This phase difference, when carefully designed, produces the desired polar frequency response pattern. For each frequency range of interest, there is an optimum ratio of values which optimizes the polar frequency response pattern over that frequency range. In this particular case, the specified range over which to optimize the ratio is 300 Hz to 3 kHz.

The EM-3068 has a ratio of back volume to front volume of slightly less than 8:1. This is ideal for this application of the second preferred embodiment, when combined with the damping screen originally used by Knowles with the EM-3068 device. The acoustic resistance of that screen is approximately $2\times10^8$ MKS acoustic Ohms. When this acoustic-resistance is applied at each of the front and rear ports of the modified microphone element, a phase difference occurs across the specified bandwidth of 300 Hz to 3 kHz which results in the desired polar frequency response.

Figure 4A:
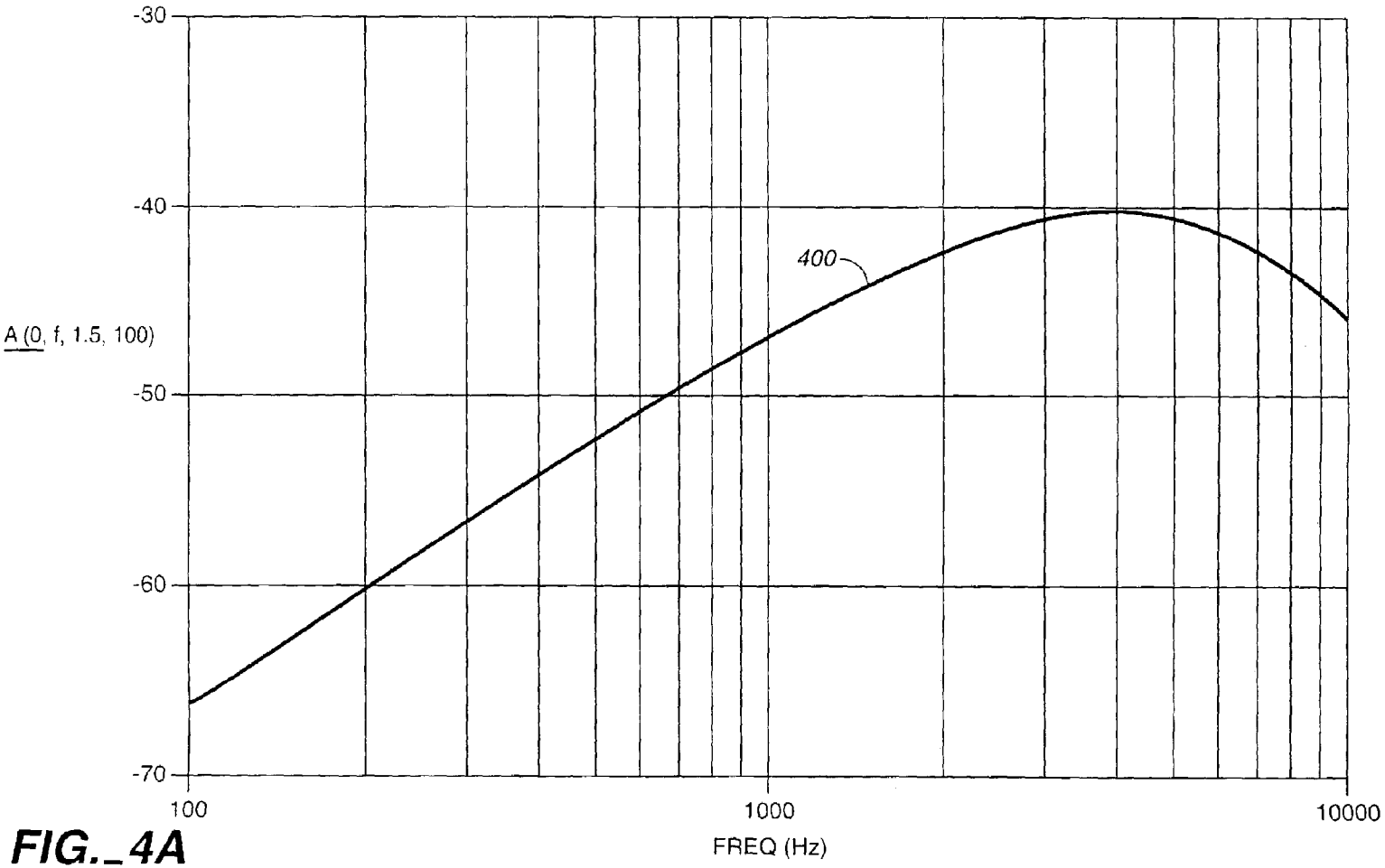
FIG. 4A shows a graph of a simulated frequency response of an embodiment of the invention when in a free field, with respect to a sound source one meter in front of the embodiment in a direction of maximum sensitivity, and also shows the mathematical equations on which the simulation is based.

FIG. 4A shows mathematical equations which represent a MathCad™ simulation of the 1 meter free field response of the microphone element of the second preferred embodiment, and also shows the simulated free field response curve 400 of the microphone element with respect to a sound source located 1 meter away from the microphone element. The simulation presumes that the microphone element is located in the free field, and not on the side of a user's head; accordingly, the response curve 400 exhibits a pressure difference bass rolloff which the bipolar microphone of the first preferred embodiment is also subject to.

Figure 4B:
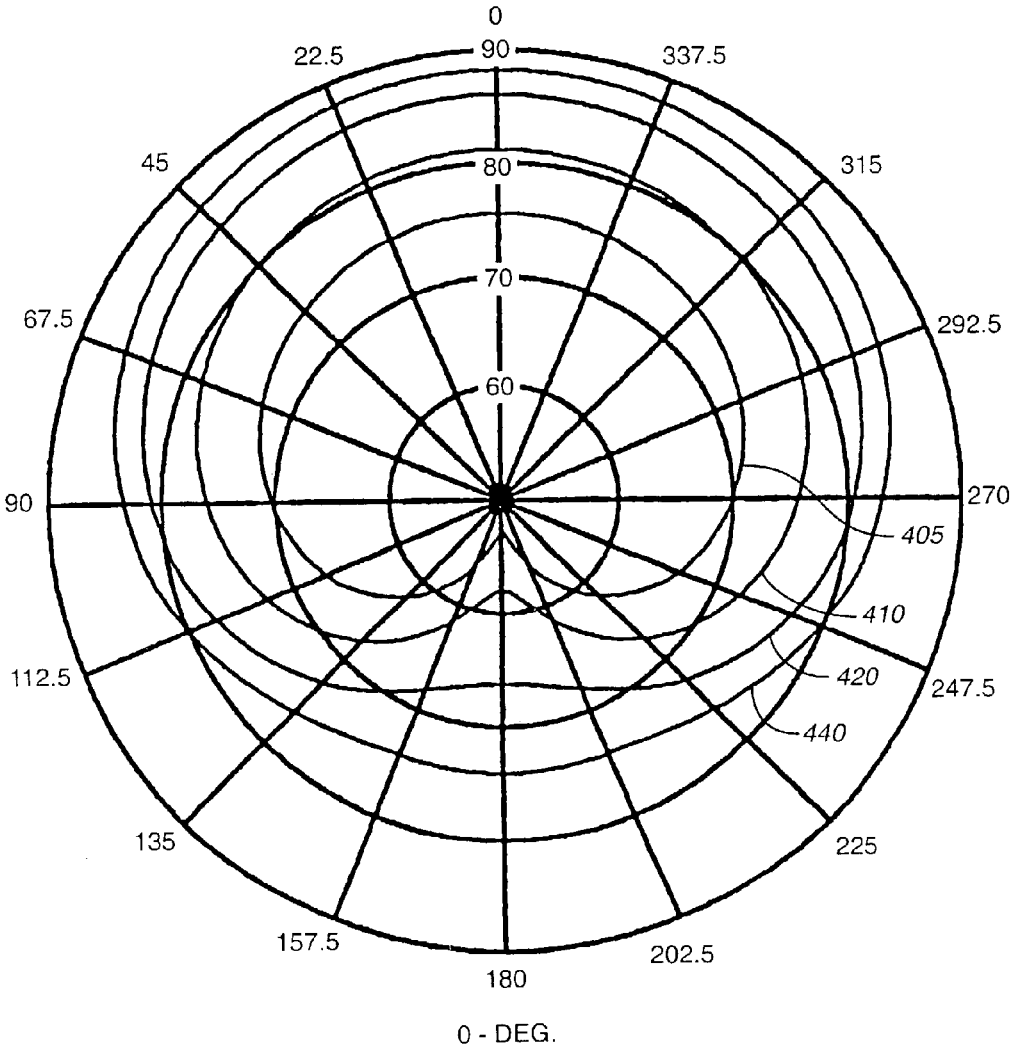
FIG. 4B is a polar graph showing a simulated frequency response of the embodiment of FIG. 4A when in a free field, with respect to a sound source one meter in front of the embodiment in a direction of maximum sensitivity which is the 0 degree direction.

FIG. 4B shows polar frequency response curves 405, 410, 420 and 440 of the microphone element for sound frequencies of 500 Hz, 1 kHz, 2 kHz and 4 kHz respectively due to a free field sound source located 1 meter away from the microphone element. The curves 405, 410, 420 and 440 demonstrate very good directionality, with over 20 dB of rejection in the rearward direction (180 degrees) at 500 Hz, 1 kHz and 2 kHz, with over 15 dB at 4 kHz (which is outside the specified 300 Hz to 3 kHz bandwidth anyhow). However, FIG. 4B also clearly shows that, in contrast to conventional prior art directional microphones, the polar response shape of the microphone element of the second preferred embodiment is different for each frequency, especially in the rearward direction (180 degrees) where sensitivity is lowest.

Figure 5:
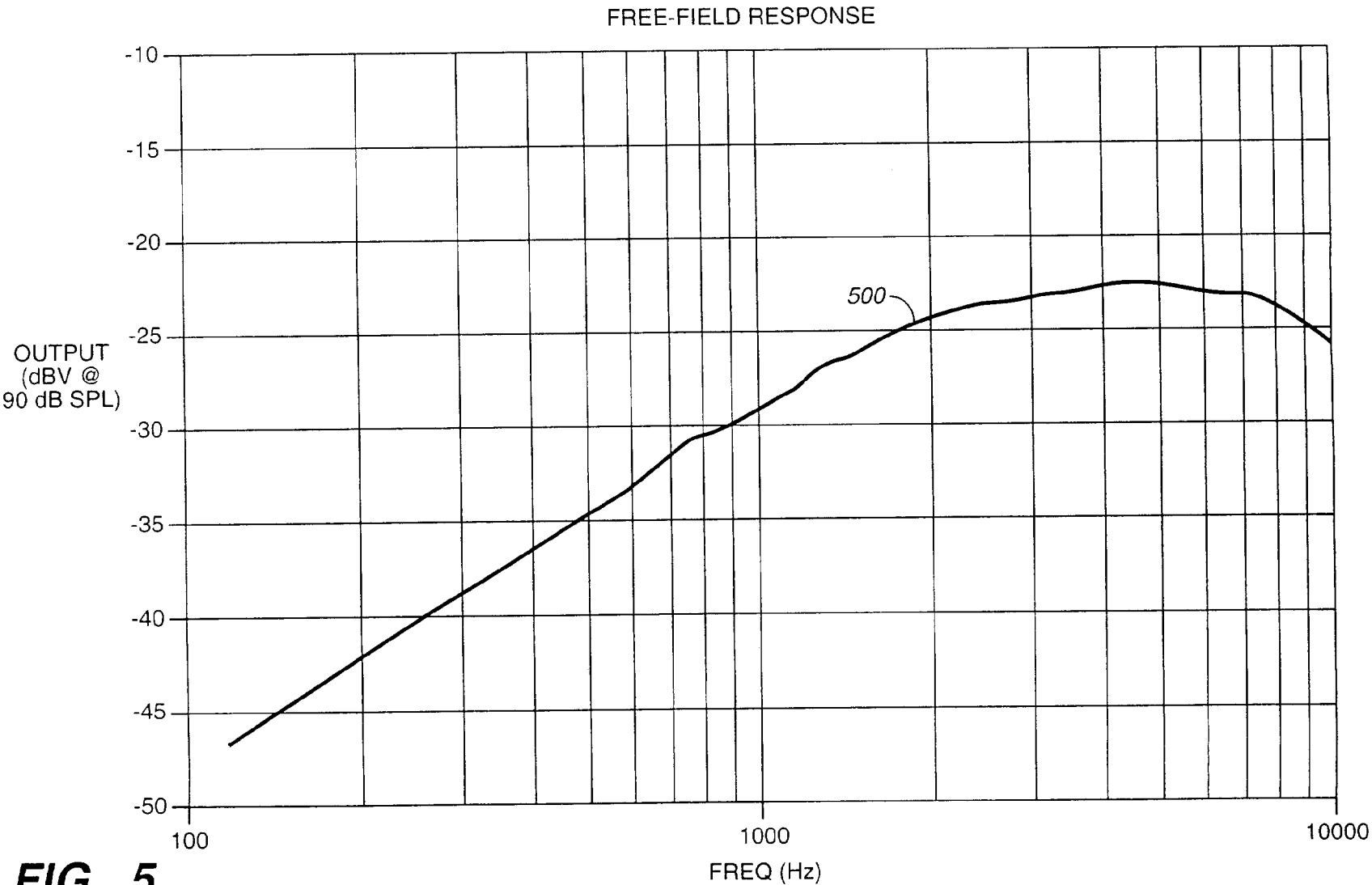
FIG. 5 is a graph of the actual free field frequency response of the embodiment of FIG. 4A in the maximum sensitivity direction.
Figure 6:
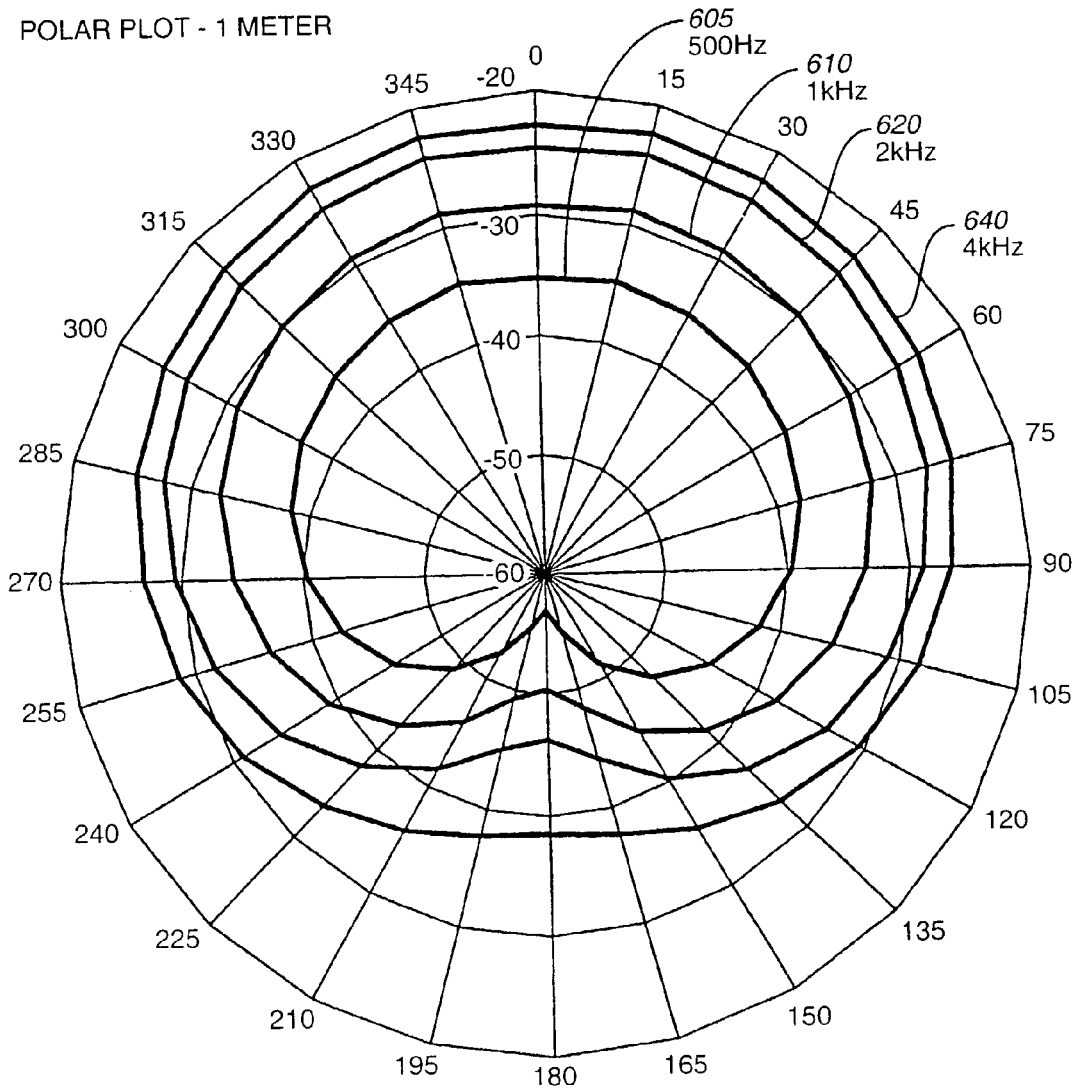
FIG. 6 is a polar graph of the actual frequency response of the embodiment of FIG. 4A when in a free field, with respect to a sound source one meter in front of the embodiment in a direction of maximum sensitivity which is the 0 degree direction.

FIG. 5 shows an actual free field response curve 500 of a microphone element constructed as shown in FIG. 3 and described above, with respect to a sound source located 1 meter away from the microphone element in the 0 degree direction. As can be seen from FIGS. 4A and 5, the simulated response 400 compares well with the actual response 500. FIG. 6 shows an actual free field polar frequency response for the microphone element, where the sound source is located 1 meter away from the microphone element and the curves 605, 610, 620 and 640 represent the response at 500 Hz, 1 kHz, 2 kHz and 4 kHz respectively. Except for slight deviations at the "back" of the 4 kHz pattern, in the 180 degree direction, the simulated polar frequency response shown in FIG. 4B compares well with the actual polar frequency response shown in FIG. 6. Note, the absolute scales differ amongst the graphs because no effort was made to account for amplifier gains or microphone sensitivities. Only relative amplitudes were intended to be modeled and shown.

Figure 7:
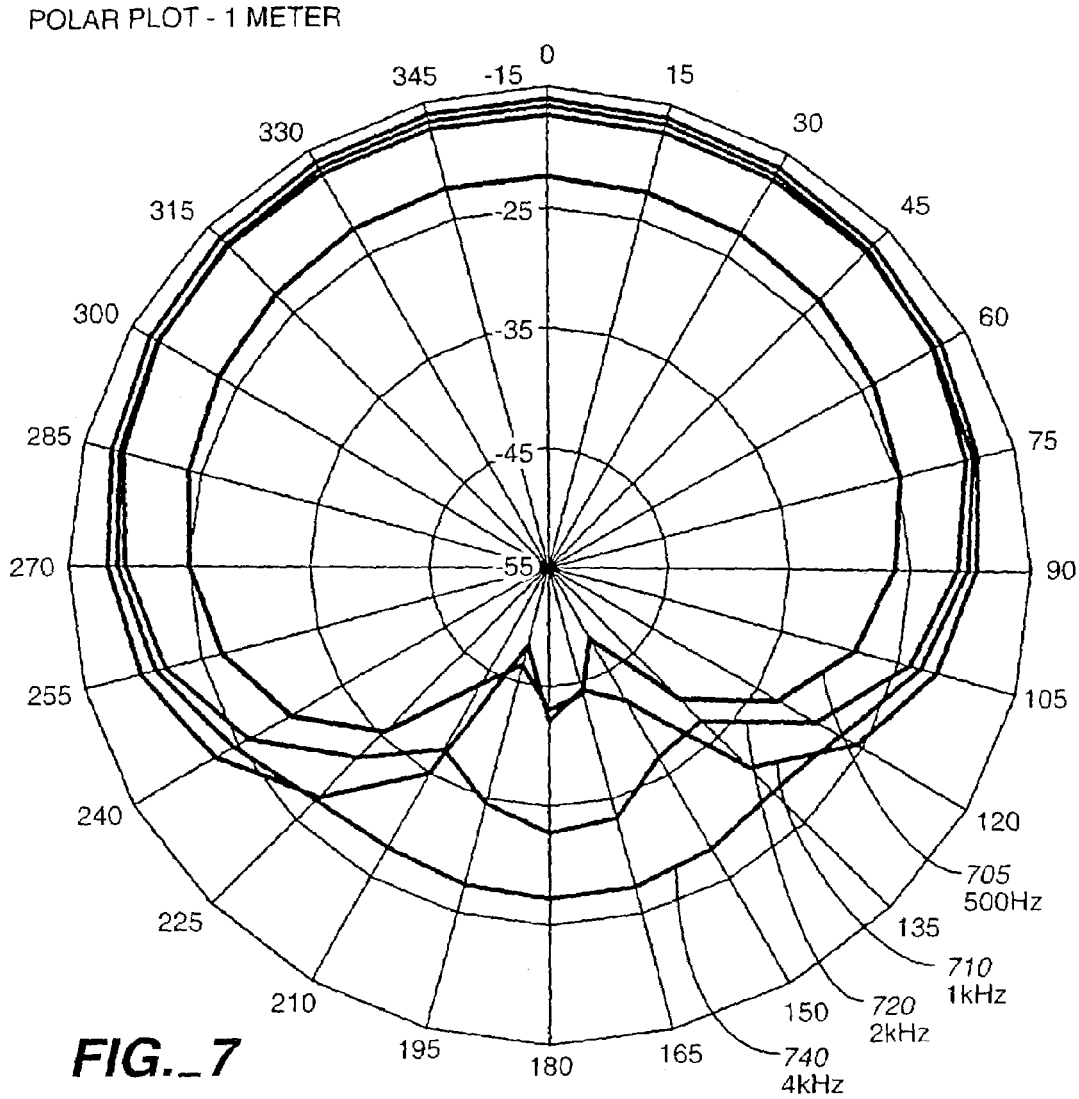
FIG. 7 is a polar graph of the actual frequency response of the embodiment of FIG. 4A when in a free field and contained within a microphone housing, with respect to a sound source one meter in front of the embodiment in a direction of maximum sensitivity which is the 0 degree direction.

As discussed in Bulletin TB21, the housing in which the microphone element is mounted has an effect on the frequency response of the microphone element. This effect is mostly due to the added acoustic path length that an acoustic wave must travel as it goes around the outside of the housing to reach the farther port. FIG. 7 shows the free field polar frequency response that is measured under conditions similar to those of FIG. 6, but with the microphone element of the second preferred embodiment mounted in a plastic housing having the design described in copending design application Ser. No. 29/090,548, entitled "Behind the Ear Communication Device Housing" When so housed, the acoustic path length from port-to-port is increased from about 10 millimeters to about 15 millimeters. Thus, the polar frequency response patterns are changed due to the greater acoustic port-to-port delay created for the arriving sound. As can be seen, the effect of this added arrival delay causes a small rear lobe to be formed in the polar pattern, but excellent back rejection of greater than 10 dB is still maintained over about 120 degrees of rear angle, for example from the 120 degree direction to the 240 degree direction. These results compare favorably with the simulated results shown in FIG. 4B.

FIG. 8 shows the actual free field frequency response 800 of the microphone element as measured under similar conditions to that of the response curve 500, but with the microphone element located in the plastic housing. As can be seen by comparing the curves 500 and 800, the response of the housed microphone element is significantly flatter. The "boost" in response at about 1 kHz is due directly to the added acoustic spacing of the ports created by the housing. The resulting response is very desirable, because depending on the particular application it may be acceptably flat across the entire bandwidth of interest, so that little or no equalization is required. Furthermore, since the device will be located on or very near to the side of a user's head, and preferably near the user's ear, the diffraction effect will apply. As described above and shown in FIGS. 2 and 11, the diffraction effect occurs where sound energy at frequencies below about 700 Hz are diffracted and travel from the user's mouth along the side of the user's head, creating an increase in bass as compared with a free field sound source when measured at the side of the user's head. This means that the microphone element of the second preferred embodiment of the invention, when worn on the head, will demonstrate a nearly flat voice pickup frequency response as well as good noise rejection (e.g., the difference between sensitivity of the second preferred embodiment to the user's voice and sensitivity to ambient or environmental sounds).

Figure 9:
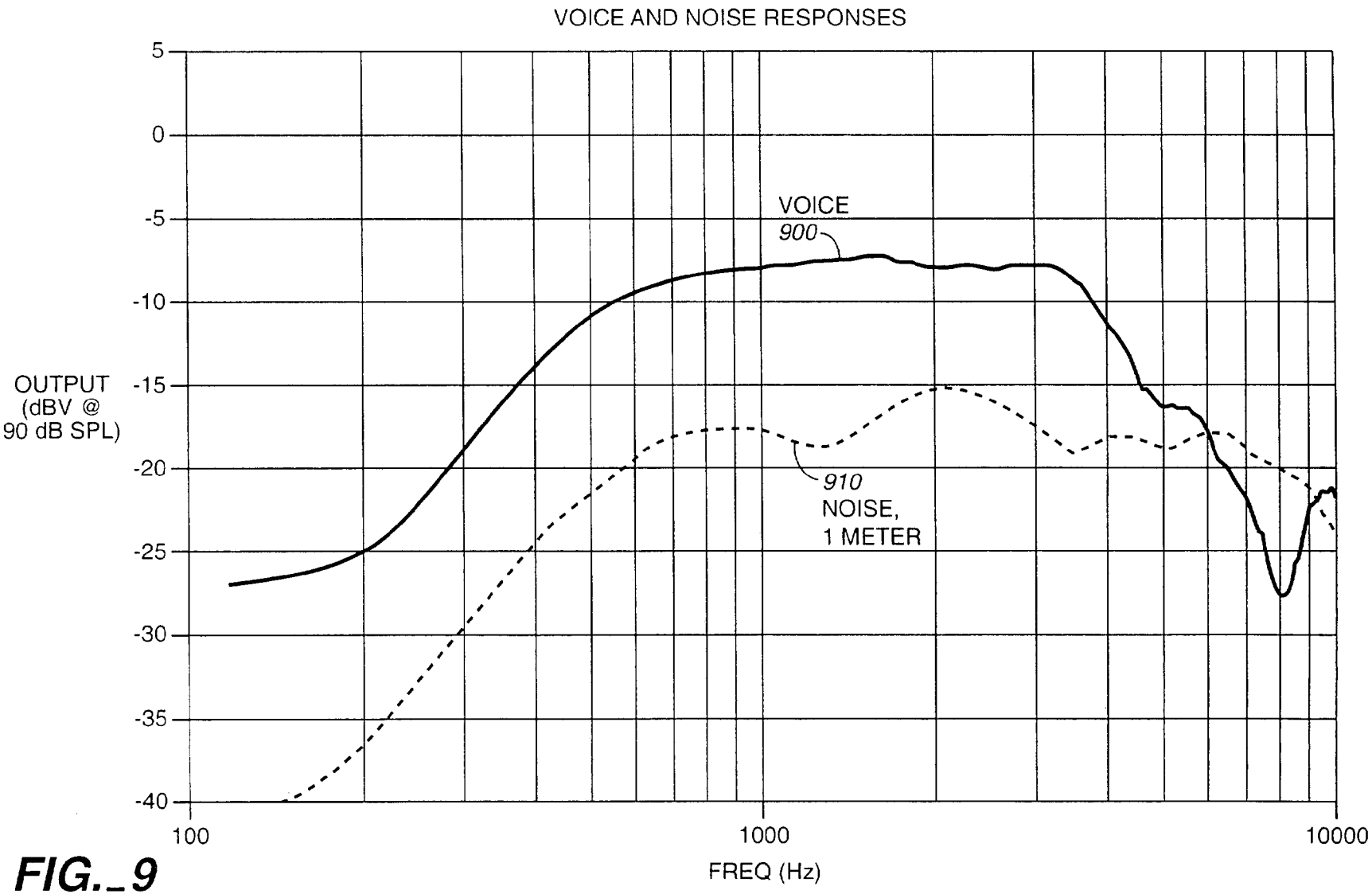
FIG. 9 is a graph showing the frequency response of the embodiment of FIGS. 7 and 8, when mounted on the user's head near the user's right ear, with respect to the user's speech sounds and with respect to a sound source one meter in front of the user.

In particular, when an earpiece containing the microphone element of the second preferred embodiment mounted in the plastic housing is placed alongside the user's head over the user's ear in a forward orientation at the position where it would normally be worn, an actual frequency response 900 shown in FIG. 9 can be measured with respect to the user's own voice. As the curve 900 shows, the diffracted energy further flattens the frequency response of the earpiece in the bass region. The frequency response in the bass region is sufficiently flattened so that very little additional electronic bass boost equalization is desirable or necessary to create a flat response over the full range of the specified 300 Hz to 3 kHz bandwidth. The steep rolloff above 3.5 kHz is deliberately added into the electronics for the earpiece to prevent possible overdrive of the attached communication device's input circuit.

The response curve 910 shown in FIG. 9 indicates the actual frequency response that can be measured under these conditions with respect to a free field sound source located 1 meter in front of the earpiece (and the user). The noise rejection (i.e., the difference between the curves 900 and 910) is not as large in the forward (0 degree) direction as in the simple bipolar pressure gradient microphone element of the first preferred embodiment. However, this is more than made up for by the excellent additional polar rejection in the rearward 180 degree direction provided by the device of the second preferred embodiment.

Figure 10:
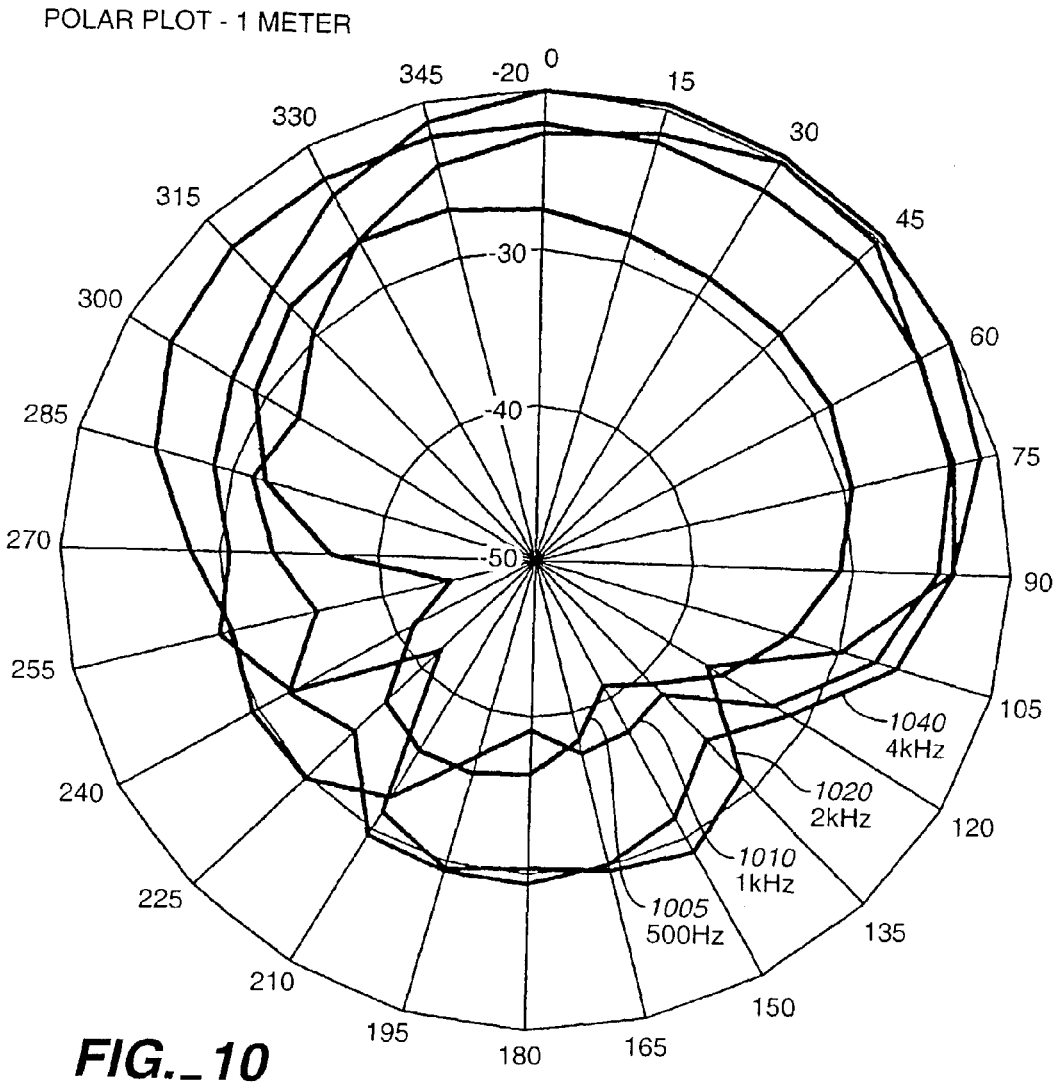
FIG. 10 is a polar graph showing the frequency response of the embodiment of FIGS. 7 and 8, when mounted on the user's head near the user's right ear.

FIG. 10 shows the polar frequency response of the earpiece containing the microphone element of the second preferred embodiment mounted in the plastic housing, when the earpiece is placed alongside the user's head over the user's ear in a forward orientation at the position where it would normally be worn. The response curves 1005, 1010, 1020 and 1040 indicated the polar frequency response 500 Hz, 1 kHz, 2 kHz and 4 kHz respectively. As these curves demonstrate, there is additional rejection of noise from noise sources located to the left of the user, on the opposite side of the user's head from the earpiece, in the 270 degree direction. This additional rejection is due to the head shadowing effect described further above. In addition, the patterns represented by the response curves 1005–1040 are shifted toward the right in the 90 degree direction, as discussed in the Bulletin TB21. Although rear lobes of the polar frequency response (in the 180 degree direction) are more pronounced in this final configuration of the second preferred embodiment, a rejection of greater than 10 dB is still maintained over nearly 180 degrees of the circle, for example from about 90 degrees to about 270 degrees, for all frequencies within the specified bandwidth of 300 Hz to 3 kHz. The best rejection still occurs at the lowest frequencies, as indicated by the 500 Hz response curve 1005. Furthermore, the polar frequency response curves shown in FIG. 10 demonstrate that the response of the final configuration of the second preferred embodiment varies depending on frequency.

In summary with respect to the first preferred embodiment of the invention, a simple, bipolar response microphone element such as a pressure gradient microphone can be provided without acoustic dampers and can be located very close to the side of the user's head, and oriented so that its axis of maximum sensitivity is parallel with the side of the user's head and pointed in the forward and rearward directions with respect to the user, so that its polar frequency response nulls are substantially aligned with a plane perpendicular to the maximum sensitivity axis. For example, the axis is preferably tilted downward from a horizontal plane at, for example, an angle ranging from about 45 degrees to about 60 degrees, in a direction toward the user's mouth. Thus, the first preferred embodiment can be aesthetically unobtrusive and highly discreet, while providing high quality capture of the user's voice together with good noise rejection, by taking advantage of the diffraction effect the user's head has on the user's voice.

In summary with respect to the second preferred embodiment of the invention, the device of the first preferred embodiment can be further improved by adding acoustic resistors or acoustic dampers to both ports of the pressure gradient microphone element that cooperate with air volumes in the microphone element that are accessed by the ports, to create a phase difference that results in additional, desirable directional characteristics. In particular and in contrast to the classical directional microphone element of the prior art, the resulting directional response varies with frequency, thus allowing greater rejection at lower frequencies where noise problems are typically more severe.

In accordance with other embodiments of the invention, different frequency ranges can be specified, and pressure gradient microphones having different front and back air volumes can be used. The invention can also be used in other applications besides head-mounted microphone elements intended to capture the user's speech sounds. For example, the present invention can be advantageously applied in any situation where it is desirable to accurately capture sound emitted from a sound source at a surface, using a microphone element located remotely from the sound source.

In accordance with another embodiment of the invention, a conventional directional microphone element is located on or near the user's head, for example near the user's ear, and is oriented to receive sounds that are emitted from the user's mouth and which travel along the surface of the user's head to the microphone element. The microphone element can be oriented so that its direction of maximum sensitivity points toward the user's mouth, or in a direction along the surface of the use's head in which sound from the user's mouth will travel on its way to the microphone element. The microphone element can be a conventional directional microphone element having delay networks, as described further above.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A sound capture system for capturing diffracted sound emitted by a source at a surface, comprising:

a directional microphone located near the surface, wherein the directional microphone has an axis of maximum sensitivity that is tangential to the surface and directed towards the source of diffracted sound, wherein the directional microphone captures the diffracted sound traveling along the surface.

2. The sound capture system of claim 1, wherein a wavefront associated with the diffracted sound is perpendicular to the axis of maximum sensitivity.

3. The sound capture system of claim 1, wherein the directional microphone is a pressure gradient microphone.

4. The sound capture system of claim 1, wherein the surface is a facial surface of a user, wherein the source of the diffracted sound is a mouth of the user.

5. The sound capture system of claim 1, wherein the surface is convex.

6. The sound capture system of claim 1, wherein the surface is convex, and wherein a portion of the surface is interposed between the directional microphone and the source.

7. The sound capture system of claim 1, wherein the directional microphone has a free field directional response exhibiting a figure 8 pattern when represented on a polar graph, and wherein a long axis corresponding to the free field directional response polar graph is parallel to the surface and directed towards the source of diffracted sound.

8. A method of capturing sound emitted by a source, comprising the steps of:

locating a directional microphone near a surface, wherein the directional microphone has an axis of maximum sensitivity;

aligning the axis of maximum sensitivity towards the source and tangential to the surface; and capturing sound emitted by the source at the directional microphone, wherein the captured sound is diffracted by the surface.

9. The method of claim 8, wherein a wavefront associated with the diffracted sound is perpendicular to the axis of maximum sensitivity.

10. The method of claim 8, wherein the directional microphone is a pressure gradient microphone.

11. The method of claim 8, wherein the surface is a facial surface of a user, and wherein the source of the diffracted sound is a mouth of the user.

12. The method of claim 8, wherein the surface is convex.

13. The method of claim 8, wherein the surface is convex, and wherein a portion of the surface is interposed between the directional microphone and the source.

14. A method of capturing sound emitted by a user, comprising the steps of:

locating a directional microphone near a facial surface of the user, wherein the directional microphone has an axis of maximum sensitivity;

aligning the axis of maximum sensitivity tangential to the facial surface and towards a mouth of the user, wherein a portion of the facial surface is interposed between the directional microphone and the user's mouth; and capturing sound emitted by the user at the directional microphone, wherein the captured sound is diffracted by the facial surface.

15. The method of claim 14, wherein a wavefront associated with the diffracted sound is perpendicular to the axis of maximum sensitivity.

16. The method of claim 14, wherein the directional microphone is a pressure gradient microphone.

17. A sound capture system for capturing diffracted sound emitted by a mouth of a user, comprising:

a directional microphone configured to be mounted on a side of the user's head, wherein the directional microphone has an axis of maximum sensitivity that is tangential to a facial surface of the user and directed towards the mouth, wherein the directional microphone captures the diffracted sound traveling along the surface of the facial surface.

18. The sound capture system of claim 17, wherein a wavefront associated with the diffracted sound is perpendicular to the axis of maximum sensitivity.

19. The sound capture system of claim 17, wherein the directional microphone is a pressure gradient microphone.

20. The sound capture system of claim 17, wherein the directional microphone has a free field directional response exhibiting a figure 8 pattern when represented on a polar graph, and wherein a long axis corresponding to the free field directional response polar graph is parallel to the surface and directed towards the source of diffracted sound.

* * * * *